US006128907A

United States Patent [19]

Mori

[11] Patent Number: 6,128,907

[45] Date of Patent: Oct. 10, 2000

[54] COOLING AND HEATING DEVICE BY USING GAS AND HEAT PIPE

[76] Inventor: Hiroki Mori, 2795-17, 6-chome, Higashi-sayamagaoka, Tokorozawa-city, saitama-pref., Japan

[21] Appl. No.: 08/714,601

[22] Filed: Sep. 16, 1996

[51] Int. Cl.[7] ..... F25B 9/02

[52] U.S. Cl. ..... 62/5; 62/910

[58] Field of Search ..... 62/5, 910

[56] References Cited

U.S. PATENT DOCUMENTS

| | | | |
|---|---|---|---|
| 2,698,525 | 1/1955 | Lindenblad | 62/5 |
| 2,770,103 | 11/1956 | Florea | 62/5 |
| 5,010,736 | 4/1991 | York et al. | 62/5 |
| 5,205,126 | 4/1993 | Schnurr et al. | 62/5 |

FOREIGN PATENT DOCUMENTS

| | | | |
|---|---|---|---|
| 300726 | 10/1969 | U.S.S.R. | 62/5 |

*Primary Examiner*—William Doerrler

[57] ABSTRACT

In this cooling and heating device by using gas and heat pipe of this invention, which is different from the conventional method, perfectly non-polluting gas, including air, is used as a refrigerant material, without changing of state, in the open loop circuit. The temperature separation of lower temperature and higher temperature is accomplished by a rapid gas expansion means, a high speed gas rotation means and a high speed heat transport means which includes a heat pipe. This device can be applied as a perfectly non-polluting operating principle of a cooling and/or heating device for general use, it can be used in wide area such as factories, stock houses, offices, homes, cars, ships, aircraft, etc.

9 Claims, 5 Drawing Sheets

COOLING AND HEATING DEVICE BY USING GAS AND HEAT PIPE

FIELD OF THE INVENTION

This invention relates to a cooling and heating device by using gas and heat pipe as refrigerant material that is used without changing of state.

This invention can be applied as an operating principle for general use of a cooling device and/or a heating device, which will be used in wide area such as factories, stock houses, offices, homes, cars, ships, aircraft, etc.

BACKGROUND OF THE INVENTION

The cooling and heating device commonly used up to now utilizes heat radiation and/or heat absorption that occurs at the time when the state of refrigerant material changes. Most of the refrigerators, freezers, air conditioning device, and so on which are operated by usual cooling and heating device are using CFC material (Chloro-Fluoro-Carbon 11, 12, 113, 114, 115, etc.) or ammoniac material. These material radiates heat (temperature goes up) or absorbs heat (temperature goes down) when its state changes from a gas state to a liquid state or from a liquid state to a gas state, respectively.

Above mentioned CFC technology has long history, and it has been well polished, but increasing of pressure, decreasing of pressure, radiating of heat, and absorbing of heat have to be made in closed loop circuit. Then, the device is compelled to become complicated, and as a result, its cost has to become higher. Furthermore, when a refrigerating device, a freezing device, and an air conditioning device are abandoned after use, there occurs a big problem for the earth environment that CFC gas diffuses and rises in the atmosphere, and breaks ozone later.

Then, the using of such material as CFC is in the tendency of prohibition in the world. In stead of CFC, several alternative materials have been developed and some of them have become in utility phase today, but they are not perfect environmentally non-polluting yet, they will also be prohibited in near future.

On the other hand, though ammoniac material has less environmental polluting problem by comparison to CFC, but it has stimulative smell and poison, then, mass use of ammoniac material is not desirable.

From these reasons mentioned above, the realization of a perfect non-polluting cooling and heating device is strongly desired today.

SUMMARY OF THE INVENTION

The cooling and heating device of this invention is different from the conventional method, only perfect non-polluting gas including air but not limited air, is used as a refrigerant material, without changing of state and in an open loop circuit.

In this invention, a high-pressure gas (including air) is used as a source energy of temperature separation. The high-pressure gas, which is inputted into the cooling and heating device, is separated to a lower temperature gas and a higher temperature gas.

This Temperature Separation Action of higher temperature and lower temperature, which occurs with gas separation, is accomplished by rapid decrease of pressure or rapid expansion, and high speed rotation of the input gas. The lower and higher temperature gas which has been separated can be used directly for cooling use or heating use by taking out to the outside of the device without using a heat exchanger, and Temperature Separation Efficiency becomes higher by providing a means which transports only temperature (the lower and/or higher temperature) in high speed.

The higher and lower temperature that is transported outside of the device is moved to a temperature-carrying medium, and they can be used for the following stage.

Therefore, for instance, by using the perfect non-polluting air as an input gas (refrigerant material) and the perfect non-polluting air or water as a temperature carrying medium, perfect non-polluting cooling or heating system can be realized.

And by this invention, wide simplification of the system and big cost down can be realized by comparison to the conventional method.

The total constitution of cooling and heating device of this invention is shown in FIG. 1.

In FIG. 1, the total constitution provides two main parties, they are a high pressure gas supply means (10) and a cooling and heating means (7). The high pressure gas supply means (10) provides elements from (1) to (6) in FIG. 1, and a higher temperature output medium (8) and a lower temperature output medium (9) comes out from the cooling and heating means (7).

At first, the high pressure gas supply means (10) is explained as follows:

A usual pressure input gas (1) is inputted into a gas compression means (2), where the high-pressure gas is made. In case the input gas is air, a usual and traditional air-compressor can be used as the gas compression means (2).

In the process to make high-pressure gas by the gas compression means (2), the temperature of the gas, that is a refrigerant material, is increased according to the gas theory. This increased temperature is transported by a temperature transport means (3), and it is taken out to the outside by a higher temperature output medium (4). A high heat conductivity metal or a heat pipe can be used as the temperature transport means (3), and as the higher temperature output medium (4), gas which includes air, liquid which includes water, liquid metal, or etc. can be used.

Except those elements from (1) to (4), the system provides a dehydration means (5), if necessary, which dehydrates humidity from the high pressure gas, and a flow rate control means (6) which controls the flow rate of the gas to the cooling and heating means (7) in the next stage.

Secondary, principle figure of the cooling and heating means (7) is shown in FIG. 2. This means (7) provides a rapid gas spouting and expansion means (72), a high speed gas rotation support means (73) if necessary, and a high speed gas and/or temperature transport means (76 and 77).

The rapid gas spouting and expansion means (72) spouts and expands an input high pressure gas (70) rapidly, and decreases the temperature of this gas. The high speed gas rotation support means (73) supports to rotate the input high pressure gas (70) in high speed, and concentrates a lower pressure and lower temperature gas (74) and a higher pressure higher temperature gas (75) in the central area and the outer area of the rotation, respectively. Thus, temperature separation is accomplished.

The high-speed temperature transport means (76 and 77) transport the gas and/or only temperature, which is separated by the high speed gas rotation, to the outside of the device. The first embodiment of the invention:

This embodiment of the invention is a cooling and heating device, in which gas as refrigerant material is used without change of state of the gas, and the principle of the temperature separation section is shown in FIG. 2.

This invention provides a cylindrical container (71) which provides the gas input means, the gas spouting and expansion means (72), the gas rotation support means (73) if necessary, the lower temperature gas and/or lower temperature output means (76), and the higher temperature gas and/or higher temperature output means (77). And, at least, one heat pipe is used as the lower temperature gas and/or lower temperature output means (76) and/or the higher temperature gas and/or higher temperature output means (77).

The second embodiment of the invention:

The container (71) in the first embodiment of the invention is cylindrical shape.

The third embodiment of the invention:

In the first and second embodiments of the invention, the cylindrical container (71) provides a gas spouting and expansion means (72) on its cylindrical wall, and the gas spouting and expansion means (72) provides a gas spouting nozzle which is settled towards inside of the cylindrical container (71).

The fourth embodiment of the invention:

In the first, second and third embodiments of the invention, in order to make spouting, rapid expansion, and high-speed rotation of gas at the same time, the gas spouting direction of the gas spouting nozzle is settled in a suitable and reasonable angle to the line towards the central axis and to the axis line of the cylindrical container (71).

The fifth embodiment of the invention:

In the first embodiment of the invention, the lower temperature gas and/or lower temperature output means (76) and/or the higher temperature gas and/or higher temperature output means (77) provides one or plural tube shape bodies or one or plural through holes on the end wall of the cylindrical container (71), one end of them is settled inside, the other end outside of the cylindrical container (71).

The sixth embodiment of the invention:

In the first and fifth embodiments of the invention, in order to decrease the flow resistance of the input and output gas, and to decrease the output gas temperature more, the lower temperature gas output means (76) is constituted by a tube shape body which provides a trumpet shape body at its gas input end and/or gas output end.

The seventh embodiment of the invention:

In the first, fifth and sixth embodiments of the invention, the tube shape body which is provided on the container (71) as the lower temperature gas and/or lower temperature output means (76), the part of the tube shape body where it is laid inside of the cylindrical container (71), it provides many small through holes on the side wall of it, or the side wall itself is constituted of spongy material and/or heat well-transporting material.

The eighth embodiment of the invention:

In the first embodiment of the invention, the temperature output means (76) or (77) provides a heat pipe which is settled parallel to the central axis of the cylindrical container (71), and one part of the heat pipe is laid inside of the cylindrical container (71), and the other part is laid outside of that. And in case of taking out the lower temperature, the heat pipe is laid along the central axis of the cylindrical container (71), whereas in case of taking out the higher temperature, the heat pipe is laid along inside surface of the cylinder wall of the container (71).

The ninth embodiment of the invention:

In the first and eighth embodiments of the invention, the outer part of the heat pipe provides a heat radiation fin, a blower, a water cooling jacket or another heat radiation or heat collection/recovery means.

The tenth embodiment of the invention:

In the first and fourth embodiments of the invention, the gas rotation support means (73) provides an almost cylindrical shape body, and the body provides one or plural eddy slit guide of gas (78) which supports the input gas to make high speed gas rotation by itself.

1 input gas.
2 gas compression means.
3 temperature transport means or temperature output means.
4 high temperature output medium.
5 dehydrating means.
6 flow rate control means.
7 temperature separation means.
8 higher temperature output medium.
9 lower temperature output medium.
10 high pressure gas supply means.
70 high pressure gas.
71,71A container or cylindrical container.
72 rapid gas spouting and expansion means.
73 high speed gas rotation support means.
74 lower temperature gas.
75 higher temperature gas.
76 lower temperature gas and/or lower temperature output means.
77 higher temperature gas and/or higher temperature output means.
81 higher temperature output medium.
91 lower temperature output medium.
101 lower temperature output medium.
102 temperature radiation support means.

DETAILED DESCRIPTION OF PREFERRED EMBODIMENT OF THE INVENTION

The First Example of this Invention

Figure 1:
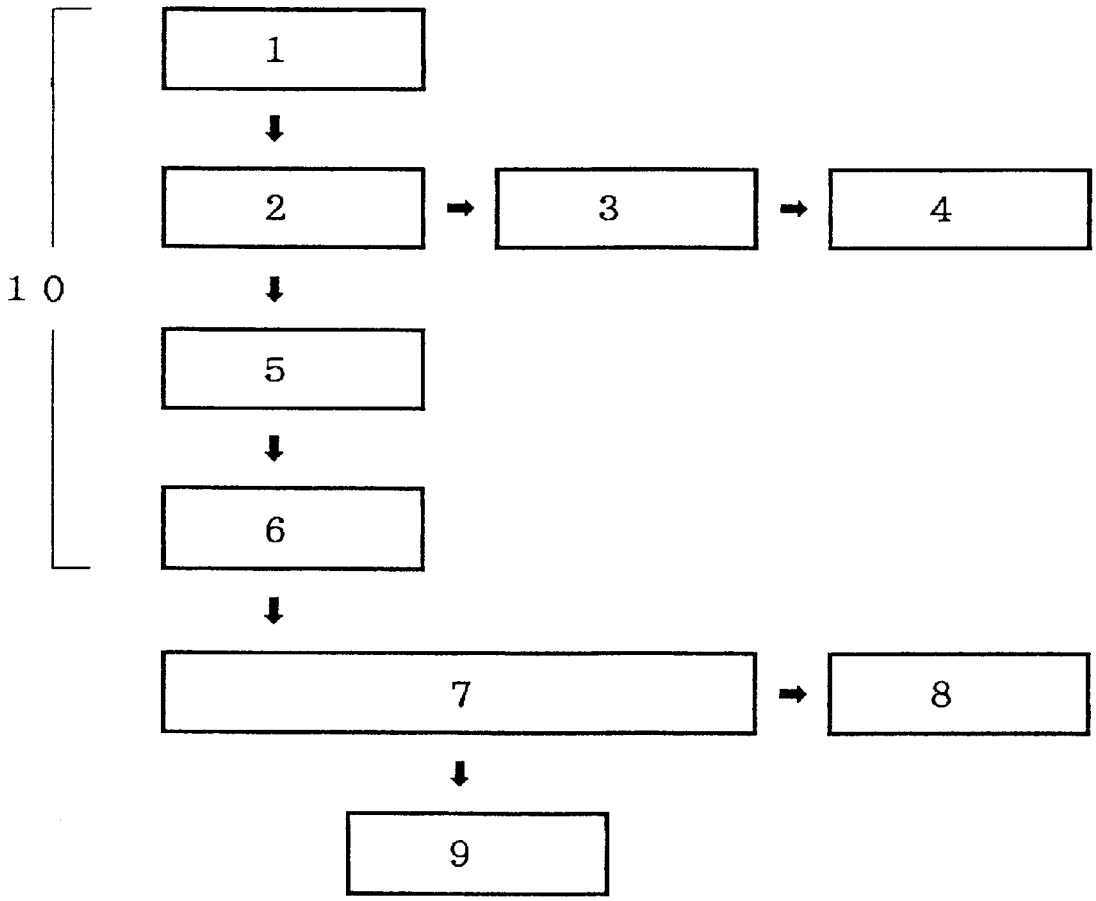
FIG. 1 is a block diagram of total constitution of this invention.
Figure 2:
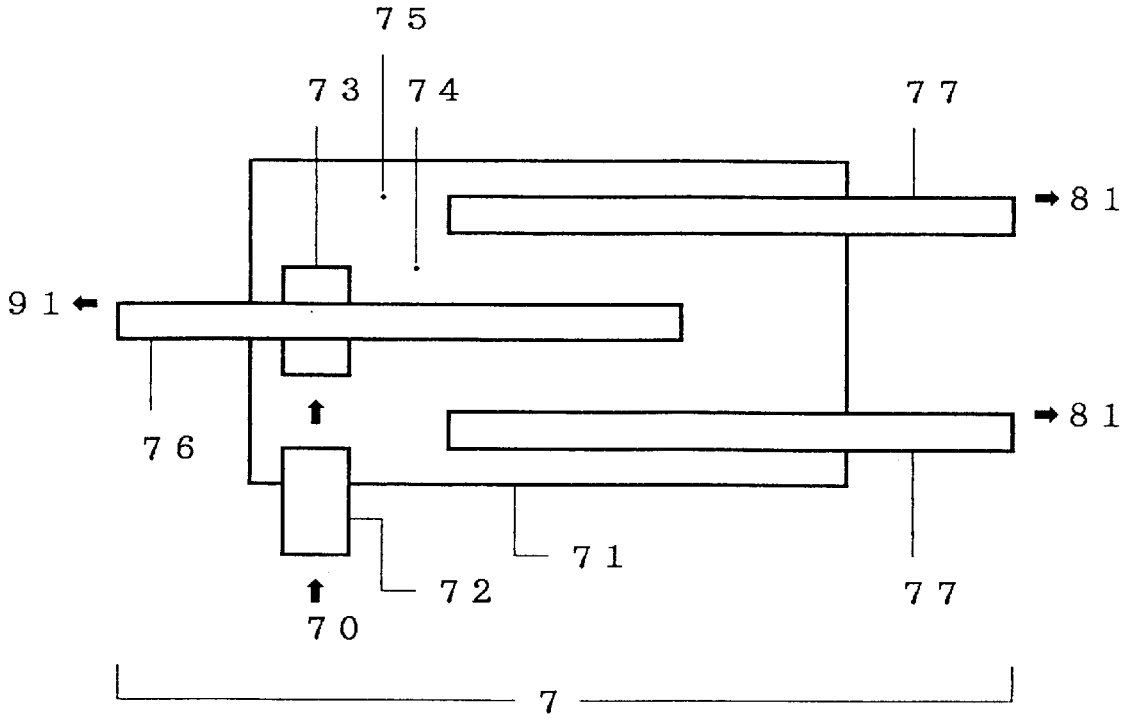
FIG. 2 is a principle figure of cooling and heating means of this invention.
Figure 3:
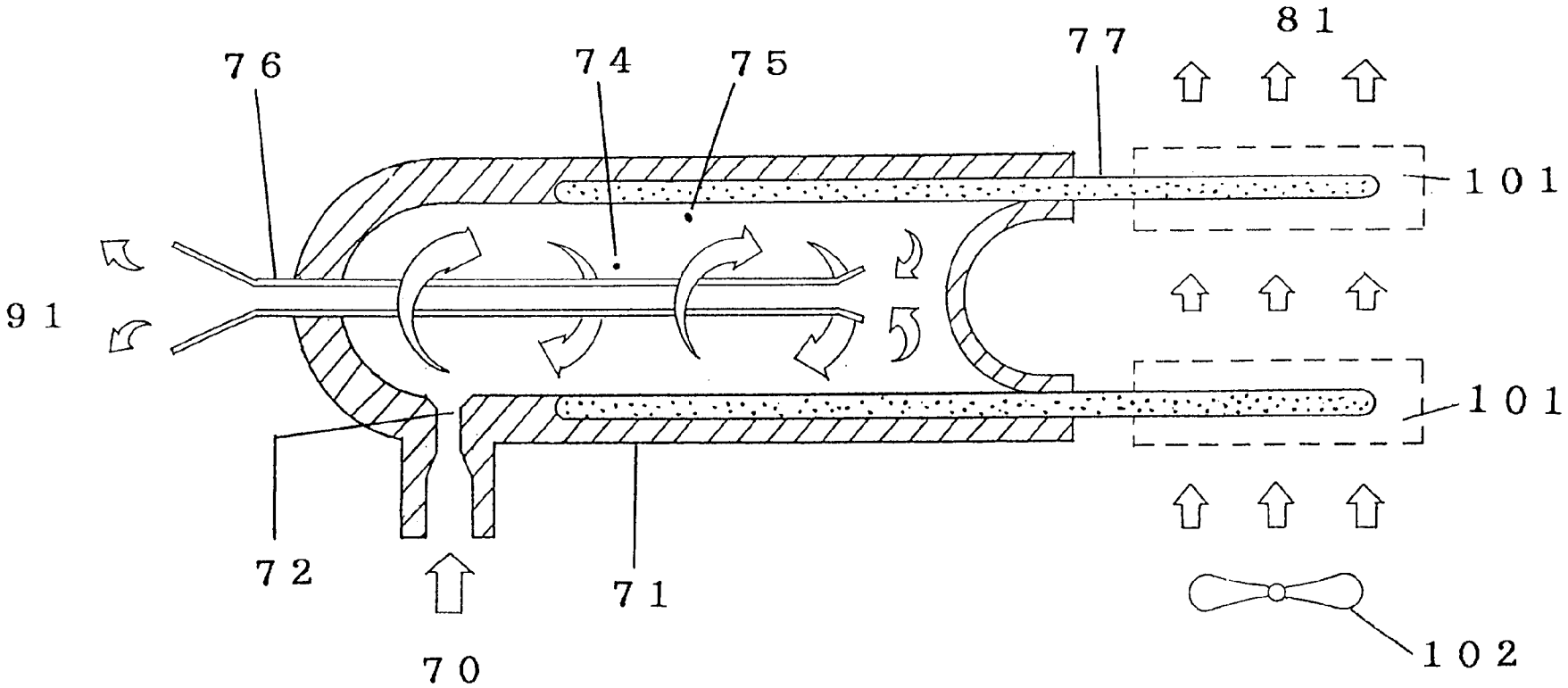
FIG. 3 is a drawing of the first example of this invention.

The first example of this invention is shown in FIG. 3. In this example, a cooling and heating means (7) provides a cylindrical container (71), a gas spouting and expansion means (72), a lower temperature gas and/or lower temperature output means (76), a higher temperature gas and/or higher temperature output means (77), a temperature radiation means (101) and a temperature radiation support means (102).

The gas spouting and expansion means (72) is settled at the end part and on the cylinder wall of the cylindrical container (71), it has a nozzle at the gas output portion, and the output direction of the nozzle is settled in a suitable and reasonable angle to the line towards the central axis and to the central axis line direction of the cylindrical container (71). The lower temperature gas and/or lower temperature output means (76) provides a slender tube shape body, one part of it is laid inside of the container (71), the other part outside. And the tube shape body provides a trumpet shape body at each end of it.

The higher temperature gas and/or higher temperature output means (77) provides one or plural heat pipes which transport only temperature of a higher temperature gas (75), and the heat pipe is laid on and along the inner surface of the side wall of the cylindrical container (71).

And on the outside part of the heat pipe, the temperature radiation means (101) such as a heat radiation fin or the others and the temperature radiation support means (102) such as a blower or others which is laid near the position where the temperature radiation means (101) is provided if it is necessary.

In the above mentioned constitution of the first example of this invention, an input high pressure gas (70) makes rapid expansion (pressure decrease), high speed rotation, and gas flow towards the right direction in FIG. 3 by the mutual effect of he nozzle and an inner surface of the cylinder wall of the container (71).

As the result of these actions mentioned above, the lower pressure-lower temperature gas (74) is concentrated in the central area of the gas rotation, and the higher pressure-higher temperature gas (75) is concentrated in the outer area of the gas rotation. Then, a temperature separation is accomplished.

The lower temperature gas (74) which is separated by the process mentioned above is taken out by the tube shape body which constitutes the lower temperature and/or lower temperature output means (76) as a lower temperature output medium (91), and it can be used directory for several purposes.

Each trumpet shape body of both ends of the tube shape body has effect to decrease flow resistance for gas, and at the output end of the tube shape body gas expansion occurs again by the trumpet shape body, then the output gas temperature becomes lower.

On the other hand, only temperature of the higher pressure-higher temperature gas (75) which is concentrated in the outer area of the gas rotation is taken out by the heat pipe which constitutes the higher temperature gas and/or higher temperature output means (77) and radiated.

Then, a higher temperature output medium (81) which is made by the method mentioned above can be used for heating or warming use. As the higher temperature output medium (81), gas which includes air, liquid which includes water, heat well-conductive metal such as aluminum, liquid metal, or others can be used.

And the higher pressure higher temperature gas (75) which is made by the cooling and heating device is decreased temperature by the process mentioned above, then thus made the lower temperature gas is taken out through the tube shape body which constitutes the lower temperature gas and/or lower temperature output means (76), together with the lower temperature gas (74) of the central area of the rotation, then the total volume of the lower temperature gas is increased, and it can be used for several purposes as the lower temperature medium (91).

The Second Example of this Invention

Figure 4:
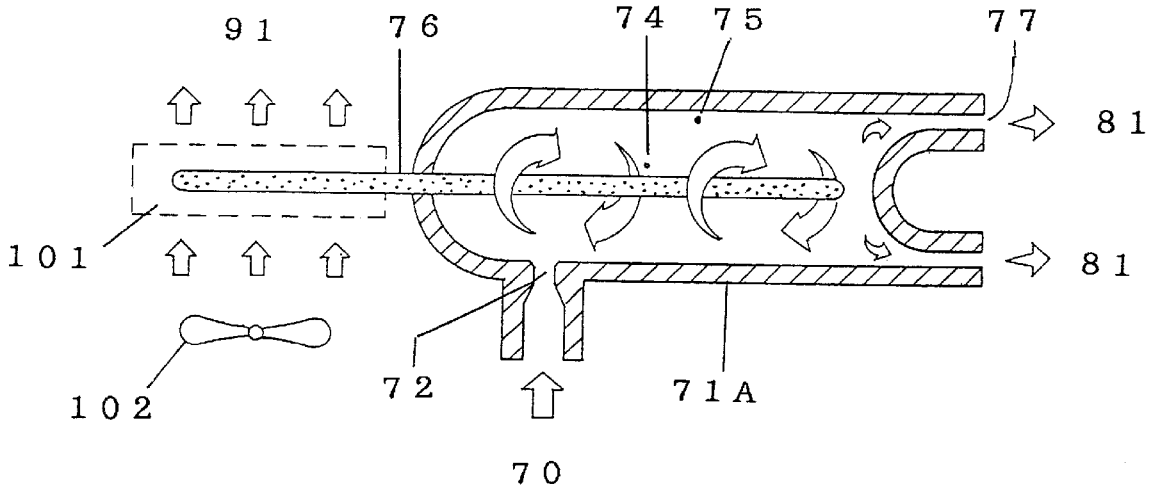
FIG. 4 is a drawing of the second example of this invention.

The second example of this invention is shown in FIG. 4.

In this example, a cooling and heating means (7) provides a cylindrical container (71A), a gas spouting and expansion means (72), a temperature radiation means (101) and a temperature radiation support means (102).

The gas spouting and expansion means (72) is constituted same as the first example of this invention, and it accomplishes the same effect. A lower temperature gas and/or lower temperature output means (76) provides a heat pipe which transports only temperature of a lower temperature gas (74), and one part of the heat pipe is settled inside of the cylindrical container (71A), the other part outside, respectively. And on the outer part of the heat pipe there provided the temperature radiation means (101) such as a radiation fin or others, and the temperature radiation support means (102) such as a blower or others, which is near the temperature radiation means (101).

In the Second Example of this Invention mentioned above, a high-pressure gas (70) which is inputted into the cooling and heating means (7) occurs rapid gas expansion and high speed rotation same as the first example of this invention, then, the temperature separation of lower temperature and higher temperature is accomplished in the cylindrical container (71A).

Only lower temperature of the lower temperature gas (74) is taken out by the lower temperature gas and/or lower temperature output means (76) which is constituted by the heat pipe, then, a lower temperature medium (91) is obtained and it can be used for several uses.

On the other hand, a higher pressure higher temperature gas (75), which is concentrated in the outer area of the gas rotation, is taken out by a higher temperature gas and/or higher temperature output means (77) which is constituted by one or plural through holes. In this case, the higher temperature gas itself is a higher temperature medium (81), and it can be used directly for several uses such as heating, warming, etc.

The Third Example of this Invention

Figure 5A:
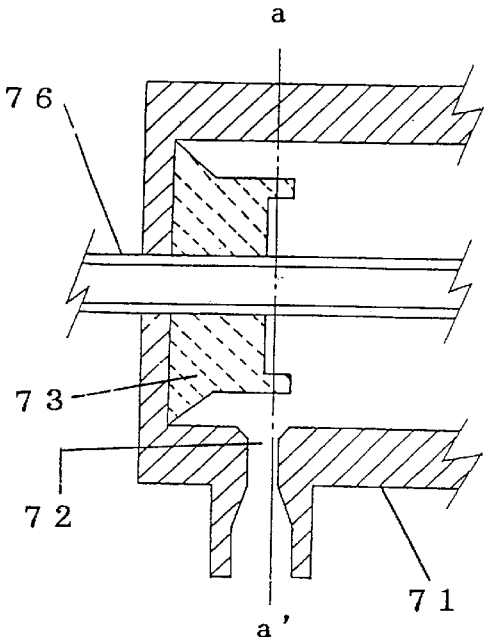
FIG. 5A is a drawing of high speed rotation guide means related to the first and second examples of this invention.
Figure 5B:
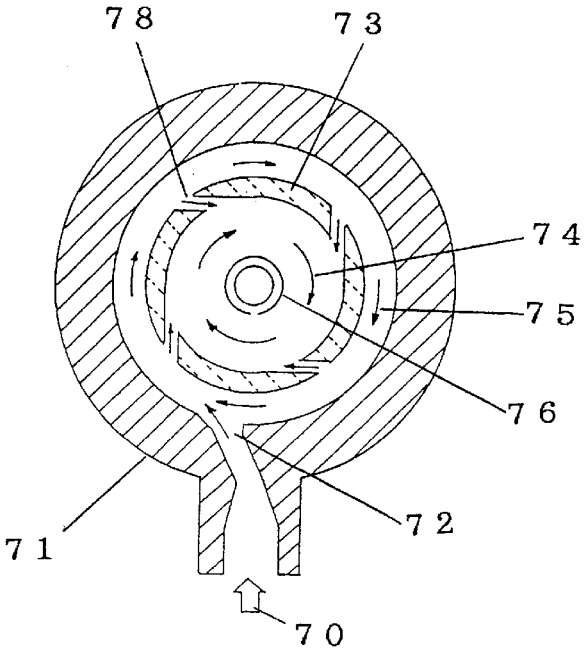
FIG. 5B is a section drawing taken on line *a—a'* of FIG. 5A.

FIG. 5A and FIG. 5B show the third example of this Invention. This example is the example of a high-speed rotation means (73) which is used for the First and the Second Examples of this Invention. FIG. 5B is the section drawing of FIG. 5A.

As shown in FIG. 5A and FIG. 5B, an almost-cylindrical shape high-speed gas rotation support means (73) is settled at the end of, and inside of the cylindrical container (71) or (71A). The high speed gas rotation support means (73) provides one or plural eddy shape gas guide slits (78) on it, the slit (78) makes support to make high speed gas rotation, then, the efficiency of temperature separation is increased.

Possibility of use in industrial field:

The cooling and heating device of this invention can be applied as a perfectly non-polluting operating principle for cooling and/or heating device for general use. It can be used in wide area such as factory, stock house, office, home, car, ship, aircraft etc.

What is claimed is:

1. A cooling device using gas as refrigerant and transferring heat using a heat pipe comprising:

a cylindrical container comprising a tangential or nearly tangential inlet for introducing, and expanding an inputted high pressure gas, outlets, arranged at one end of the cylindrical container, close to the side walls, for removing hot gas, and a heat pipe located at the central axis of the container with an end inside the container and an end extending outside the container, to transfer heat from the end of the heat pipe outside of the container into the container.

2. A cooling device as claimed in claim 1 wherein;

the tangential or nearly tangential inlet comprises a nozzle mounted on the cylindrical wall of the container so that the output direction of the nozzle is in a fixed angle, normal to the central axis of the container, in order to produce high speed rotation of the intake gas.

3. A heating device using gas as refrigerant and transferring heat using a heat pipe comprising:

a cylindrical container comprising a tangential or nearly tangential inlet for introducing, and expanding an inputted high pressure gas, an outlet pipe, arranged at one end of the cylindrical container, located at the central axis, for removing cold gas from the cylindrical container, and at least one heat pipe located adjacent to the side wall of the container with an end inside the container and an end extending outside the container, to transfer heat from the end of the heat pipe inside the container out of container.

4. A heating device as claimed in claim 3 wherein;

the tangential or nearly tangential inlet comprises a nozzle mounted on the cylindrical wall of the container so that the output direction of the nozzle is in a fixed angle, normal to the central axis of the container, in order to produce high speed rotation of the intake gas.

5. A heating device as claimed in claim 3, wherein;

a conical body is provided on at least one end of the outlet pipe.

6. A heating device as claimed in claim 3, wherein, means are provided to increase the heat transfer from the end of the heat pipe which extends outside of the container.

7. A cooling device as claimed in claim 1, wherein, means are provided to increase the heat transfer from the end of the heat pipe which extends outside of the container.

8. A cooling device as claimed in claim 1, wherein, a gas rotation guide means comprising a cylindrical shape body with at least one tangential or nearly tangential slit is positioned axially in he cylindrical container.

9. A heating device as claimed in claim 3, wherein, a gas rotation guide means comprising a cylindrical shape body with at least one tangential or nearly tangential slit is positioned axially in the cylindrical container.

* * * * *